US007993168B1

(12) United States Patent
Kim

(10) Patent No.: US 7,993,168 B1
(45) Date of Patent: Aug. 9, 2011

(54) BATTERY TERMINAL

(75) Inventor: Hwan-Chang Kim, Yongin-si (KR)

(73) Assignee: Chang Hwan Precision Terminal Co., Ltd., Dangjin-Gun (KR)

( * ) Notice: Subject to any disclaimer, the term of this patent is extended or adjusted under 35 U.S.C. 154(b) by 0 days.

(21) Appl. No.: 12/893,359

(22) Filed: Sep. 29, 2010

(30) Foreign Application Priority Data

Jul. 1, 2010 (KR) ..... 10-2010-0063570

(51) Int. Cl.
*H01R 4/50* (2006.01)

(52) U.S. Cl. ..... 439/774; 439/772

(58) Field of Classification Search ..... 439/774, 439/762, 772, 770, 756, 783, 726, 754, 764, 439/765, 760, 757
See application file for complete search history.

(56) References Cited

U.S. PATENT DOCUMENTS

| | | | | |
|---|---|---|---|---|
| 1,667,702 | A * | 4/1928 | Powell | 439/770 |
| 3,048,646 | A * | 8/1962 | England | 439/388 |
| 3,478,306 | A * | 11/1969 | McCray | 439/756 |
| 5,277,629 | A * | 1/1994 | Rissik et al. | 439/770 |

FOREIGN PATENT DOCUMENTS

| | | | |
|---|---|---|---|
| DE | 3531014 | A1 * | 3/1987 |
| KR | 10-0821595 | | 4/2008 |

* cited by examiner

*Primary Examiner* — Hae Moon Hyeon
(74) *Attorney, Agent, or Firm* — Young & Thompson

(57) ABSTRACT

A battery terminal in which opening of the inserting member of the electrode can be controlled so that the battery electrode is connected promptly and firmly, transformation of the electrode can be avoided by preventing excessively tight connection of the electrode, electric resistance is reduced by maximizing contacting surface of the electrode thereby enhancing electric conductivity, and connecting process is conveniently carried out by fastening the bolt which controls the opening of the inserting member at upper portion of the device.

4 Claims, 4 Drawing Sheets

BATTERY TERMINAL

FIELD OF THE INVENTION

The present invention relates to a battery terminal, and more particularly, to a battery terminal in which opening of the inserting member of the electrode can be controlled so that the battery electrode is connected promptly and firmly, transformation of the electrode can be avoided by preventing excessively tight connection of the electrode, electric resistance is reduced by maximizing contacting surface of the electrode thereby enhancing electric conductivity, and connecting process is conveniently carried out by fastening the bolt which controls the opening of the inserting member at upper portion of the device.

BACKGROUND OF THE INVENTION

Vehicles and many heavy duty equipments include a battery which supply power to the parts of the equipment through cables connected to the electrodes of the battery.

Generally, the cable is not directly connected to the electrode of the battery due to the possible instability and inconvenience of direct connection, but is connected by installing separable battery terminal to the electrode of the battery and then installing built-in or separable connection terminal to the battery terminal for connecting the cable.

Conventional battery terminals have inserting member to which the electrode of the battery is inserted, but, since the opening of the insertion member is not variable, the insertion of the terminal becomes difficult or the connection becomes loose in case the opening of the insertion slot is made in larger or smaller scale compared to the size of the electrode.

To solve the above problem, a battery terminal in which the opening of the insertion member into which the electrode of the battery is inserted can be controlled has recently been developed.

This type of battery aims to solve the problem of conventional battery connection terminal by controlling the opening of the inserting member of the battery terminal, but has the problem of difficulty in controlling the tightness of the electrode providing the danger of transforming the electrode when the electrode is connected too tightly. Also, the battery electrode is partially contacted with the terminal making electric resistance high and lowering electric conductivity, and the bolt for controlling opening of the inserting member is fastened at side or lower portion of the device making it difficult to connect the bolt when the bolt is located at dented portion, which reduces productivity of the work.

For the above reason, has been trying to develop a battery terminal in which opening of the inserting member of the electrode can be controlled so that the battery electrode is connected promptly and firmly, transformation of the electrode can be avoided by preventing excessively tight connection of the electrode, electric resistance is reduced by maximizing contacting surface of the electrode thereby enhancing electric conductivity, and connecting process is conveniently carried out by fastening the bolt which controls the opening of the inserting member at upper portion of the device. However, there has still been no satisfactory outcome despite the development efforts.

SUMMARY OF THE INVENTION

The present invention has been designed to solve the above mentioned problems of prior art battery terminals, and aims to provide a battery terminal in which opening of the inserting member of the electrode can be controlled so that the battery electrode is connected promptly and firmly, transformation of the electrode can be avoided by preventing excessively tight connection of the electrode, electric resistance is reduced by maximizing contacting surface of the electrode thereby enhancing electric conductivity, and connecting process is conveniently carried out by fastening the bolt which controls the opening of the inserting member at upper portion of the device.

The battery terminal according to the present invention comprises a fixing block which comprises a protrusion member having a bolt through hole on side of the outer surface of the member for connecting to the connection terminal to which a cable is connected, an inclined surface on one side of the inner surface with downward inclination, a through hole at lower portion in front of the inclined surface with inner peripheral surface in spiral shape, and a semi-circular groove at one side of the inner surface facing the inclined surface with the groove contacting the electrode of the battery; an inserting block which is inserted into the fixing block and which comprises an inclined surface on one side of the outer surface contacting the inclined surface of the fixing block with the same inclination as the inclined surface of the fixing block, a long groove at the front portion of the inclined surface, and a semi-circular groove in front of the long groove with the groove the facing the semi-circular groove of the fixing block and contacting the outer surface of the electrode of the battery; and a fixing bolt which penetrates through the long groove of the inserting block and is connected to the through hole of the fixing block.

The battery terminal of the present invention includes inclined surface at the fixing block and inserting block which enables the user to control the opening of the inserting member of the battery electrode, in other words, the portion between the semi-circular groove of the inserting block and the semi-circular groove of the fixing block into which the electrode of the battery is inserted, as the inclined surface of the inserting block moves sidewise along inclined surface of the fixing block, the inclined surface of the fixing block and the inclined surface of the inserting block being contacted in the process where the fixing bolt is connected to the fixing block after penetrating the inserting block. Therefore, the battery electrode is connected promptly and firmly, transformation of the electrode can be avoided by preventing excessively tight connection of the electrode. Also, the semi-circular groove of the inserting block and semi-circular groove of the fixing block is arranged to enclose the whole outer surface of the battery electrode so that electric resistance of the device is reduced by maximizing contacting surface of the electrode thereby enhancing electric conductivity. Further, connecting process is conveniently carried out by fastening the fixing bolt which controls the opening of the inserting member at upper portion of the inserting block and the fixing block in order to make the connection easy even when the battery electrode is located at dented place, thereby raising the productivity of the work.

Hereinafter, embodiments of the invention are explained in detail with reference to the appended drawings.

| | |
|---|---|
| 10: | fixing block |
| 11: | protrusion member |
| 11a: | bolt through hole |
| 12: | inclined surface |
| 13: | through hole |
| 14: | semi-circular groove |
| 20: | inserting block |
| 21: | inclined surface |
| 22: | long groove |
| 23: | semi-circular groove |
| 30: | fixing bolt |
| 100: | battery terminal |
| 200: | battery |
| 210: | electrode |
| 220: | cable |
| 230: | connection terminal |

DESCRIPTION OF THE PREFERRED EMBODIMENTS

Figure 1:
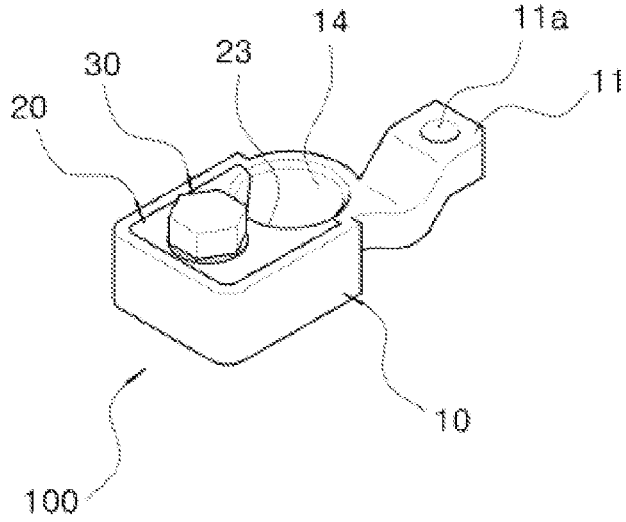
FIG. 1 is a prospective view of the appearance of the battery terminal of the present invention.
Figure 2:
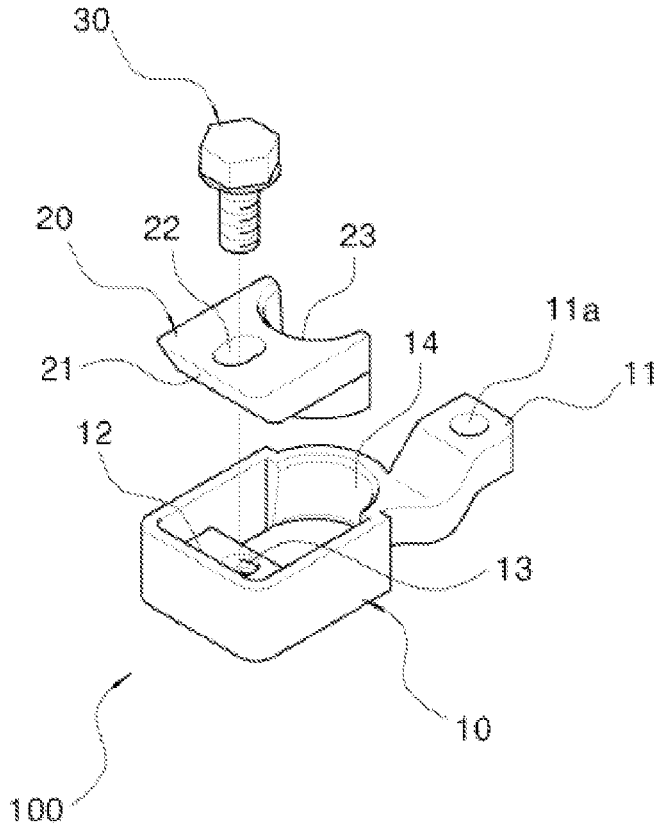
FIG. 2 is an explosive view illustrating the structure of the battery terminal of the present invention.
Figure 3:
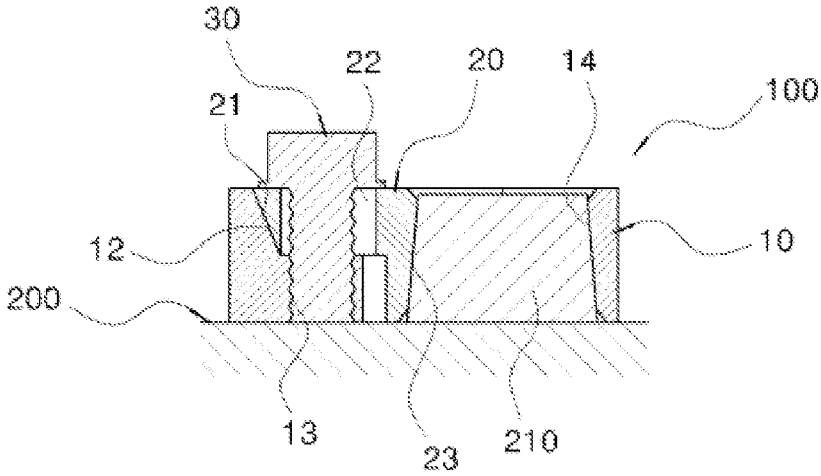
FIG. 3 is a cross sectional view illustrating the structure of the battery terminal of the present invention.

The battery terminal 100 of the present invention, as shown in FIGS. 1-3, comprises a fixing block 10, inserting block 20 and a fixing bolt 30.

The fixing block 10 comprises a protrusion member 11 having a bolt through hole 11*a* on one side of the outer surface of the member for connecting to the connection terminal 230 to which a cable 220 is connected, an inclined surface 12 on one side of the inner surface with downward inclination, a through hole 13 at lower portion in front of the inclined surface 12 with inner wall in spiral shape, and a semi-circular groove 14 at one side of the inner surface facing the inclined surface 12 with the semi-circular groove 14 contacting the electrode 210 of the battery 200.

In the fixing block 10, the semi-circular groove 14 has the same diameter as that of the electrode 210 of the battery 200, but with the diameter of the semi-circular groove 14 of the fixing block 10 preferably increasing from upper end to lower end, which is the same as the conventional electrode 210 of the battery 200 in which the diameter increases from upper end to lower end. The diameter of the semi-circular groove 14 of the fixing block 10 is set to the same value as the diameter of the electrode 210 of the battery 200, and the diameter increases from upper end to lower end so that the inner surface of the semi-circular groove 14 of the fixing block 10 and the outer surface of the electrode 210 of the battery 200 are closely contacted and the upper part of the electrode 210 of the battery 200 can be inserted easily through the inner lower side of the semi-circular groove 14 of the fixing block 10.

Meanwhile, the protrusion member 11 equipped with the bolt through hole 11*a* is provided for connection with the connection terminal 230 to which a cable 220 of the fixing block 10 is connected, which is a conventional method in the battery terminal and so is not described in detail.

The inserting block 20 is inserted into the fixing block 10 and comprises an inclined surface 21 on one side of the outer surface contacting the inclined surface 12 of the fixing block 10 with the same inclination as the inclined surface 12 of the fixing block 10, a long groove 22 at the front portion of the inclined surface 21, and a semi-circular groove 23 in front of the long groove 22 with the groove 23 facing the semi-circular groove 14 of the fixing block 10 and contacting the outer surface of the electrode 210 of the battery 200.

In the inserting block 20, the diameter of the long groove 22 is preferably larger than the diameter of the body of the fixing bolt 30. By making the diameter of the long groove 22 of the inserting block 20 larger than the diameter of the body of the fixing bolt 30, the fixing bolt 30, when connected to the fixing block 10 by penetrating the long groove 22 of the inserting block 20, the inserting block 20 itself can move sidewise by the long groove 22 through which the fixing bolt 30 penetrates.

The diameter of the semi-circular groove 23 of the inserting block 20 is set to the same value as the diameter of the electrode 210 of the battery 200, and the diameter of the semi-circular groove 23 of the inserting block 20 preferably increases from upper end to lower end, which corresponds to the conventional electrode 210 of the battery 200 having diameters increasing from upper end to lower end. By making the diameter of the semi-circular groove 23 of the inserting block 20 increasing from upper end to lower end with the same diameter as that of the electrode 210 of the battery 200, the inner surface of the semi-circular groove 23 of the inserting block 20 and the outer surface of the electrode 210 of the battery 200 is closely contacted and the upper part of the electrode 210 of the battery 200 can be inserted easily through the inner lower side of the semi-circular groove 23 of the inserting block 20.

The fixing bolt 30 penetrates the long groove 22 of the inserting block 20 and is connected to the through hole 13 of the fixing block 10.

The fixing bolt 30 is a conventionally used bolt and is not explained here.

Figure 5:
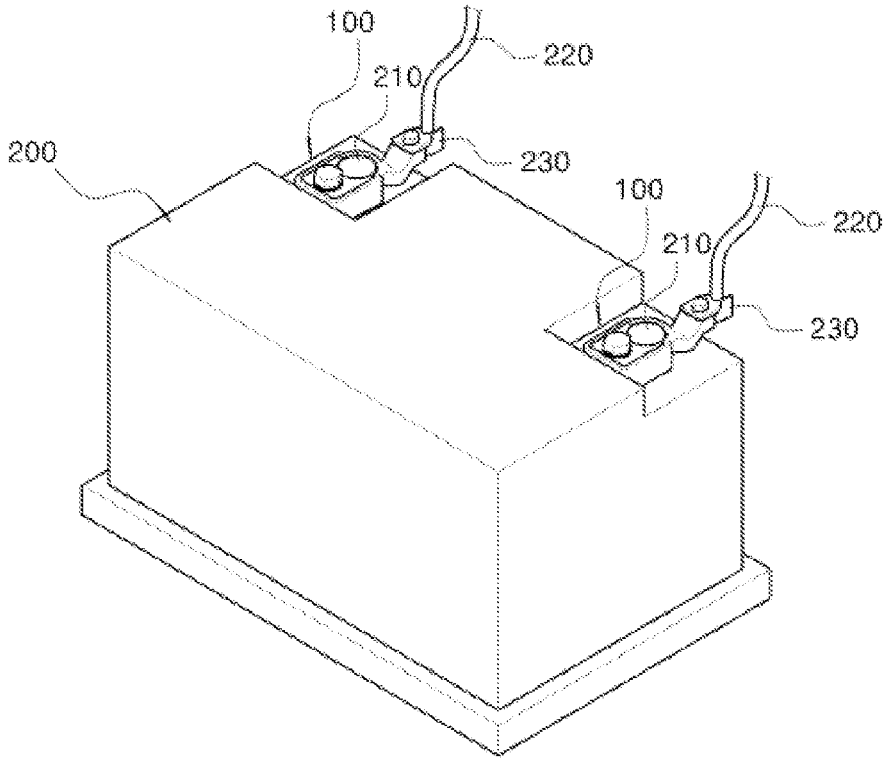
FIG. 5 illustrates the state of use showing the state where the battery terminal of the present invention is connected to the battery.

The battery terminal 100 of the present invention, as illustrated in FIG. 5, is connected to each electrode 210 of the battery 200, and the process of connecting the battery terminal 100 of the present invention to the electrode 210 of the battery 200 will be described in more detail.

First, the electrode 210 of the battery 200 is inserted to the inner side of the semi-circular groove 14 of the fixing block 10 from which the inserting block 20 is separated.

Since the diameter of the lower part of the semi-circular groove 14 of the fixing block 10 is larger than that of the upper part, the electrode 210 of the battery 200 can be inserted into the inner side of the semi-circular groove 14 of the fixing block 10 by inserting the lower end of the semi-circular groove 14 of the fixing block 10 into the upper end of the electrode 210.

Then, the inserting block 20 is inserted into the fixing block 10 in which the electrode 210 of the battery 200 is inserted.

Since one surface of the outer side of the inserting block 20 and one surface of the inner side of the fixing block 10 form inclined surfaces 21, 12 with downward inclination, the inserting block 20 is located inside the fixing block 10 by inserting the lower end of the inserting block 20 into the inner side of the fixing block 10 under the circumstance where the inclined surface 21 of the inserting block 20 and inclined surface 12 of the fixing block 10 face each other.

Then, the fixing bolt 30 is connected to the fixing block 10 where the inserting block 20 locates. A long groove 22 is formed on the inserting block 20, and the front end of the fixing bolt 30 is inserted into the inside of the long groove 22 and rotated after penetrating the long groove 22 of the inserting block 20, thereby coupling the spiral of the fixing bolt 30 and the spiral formed inside the through hole 13 of the fixing block 10. In the process of connecting the fixing bolt 30 to the fixing block 10, the outer surface of the electrode 210 of the battery 200, located between the semi-circular groove 23 of the inserting block 20 and the semi-circular groove 14 of the fixing block 10, contacts the inner surface of the semi-circular groove 23 of the inserting block 20 and the semi-circular groove 14 of the fixing block 10 while being tightened, thereby connecting the electrode 210 of the battery 200 through coupling of the fixing bolt 30 to the fixing block 10.

In the process of connecting the electrode 210 of the battery 200 of the present invention as described above, the inserting block 20 moves sidewise as the fixing bolt 30 is being inserted into the through hole 13 of the fixing block 10, thereby controlling the opening of the inserting member of the electrode 210 of the battery 200, in other words, the space between the semi-circular groove 14 of the fixing block 10 and the semi-circular groove 23 of the inserting block 20.

The process will be described further.

Figure 4A:
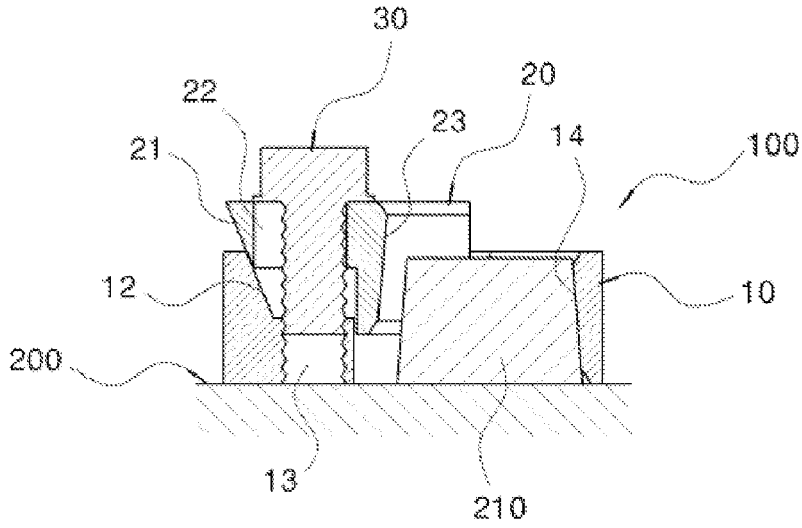
FIG. 4 shows the state of operation illustrating the control of the opening of the inserting member of the electrode of the battery terminal of the present invention.

As shown in FIG. 4*a*, at the initial stage of connecting the fixing bolt 30, the lower end of the inclined surface 21 of the inserting block 20 is located at the upper end of the inclined surface 12 of the fixing block 10, and a space is formed between the front end of the semi-circular groove 23 of the inserting block 20 and the front end of the semi-circular groove 14 of the fixing block 10, thereby securing sufficient opening of the electrode 210 of the battery 200, so the electrode 210 of the battery 200 can be inserted easily even when the inserting block 20 is connected to the fixing block 10.

Figure 4B:
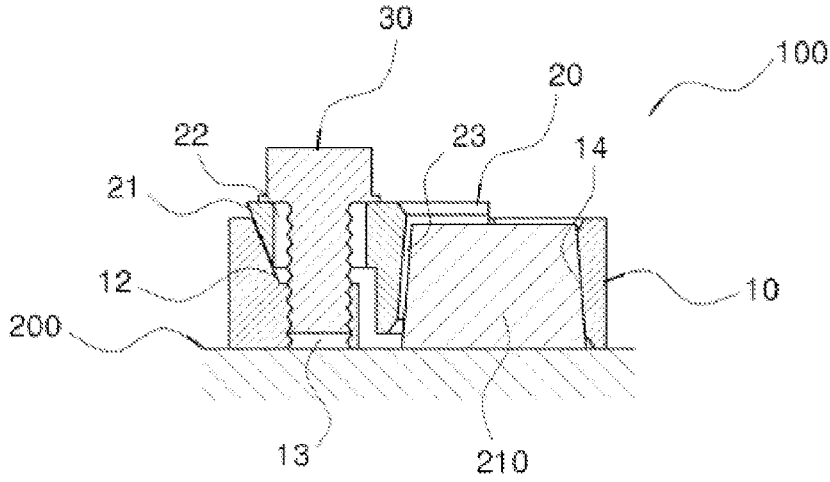

As the process of connecting the fixing bolt 30 proceeds, as shown in FIG. 4*b*, at the middle stage of connecting the fixing bolt 30, the inserting block 20 moves sidewise with inclination along the long groove 22 and the lower end of the inclined surface 21 of the inserting block 20 is located at the middle of the inclined surface 12 of the fixing block 10, thereby shortening the space between the front end of the semi-circular groove 23 of the inserting block 20 and the front end of the semi-circular groove 14 of the fixing block 10 and shrinking the opening of the inserting member of the electrode 210 of the battery 200, and connection is made by tightening the semi-circular groove 14 of the fixing block 10 and the electrode 210 of the battery 200 located inside the semi-circular groove 23 of the inserting block 20.

Then after the process of connecting the fixing bolt 30 further proceeded and the connection of the fixing bolt 30 is completed, as shown in FIG. 3, the inserting block 20 is completely moved sidewise along the long groove 22 and the lower end of the inclined surface 21 of the inserting block 20 is located at the lower end of the inclined surface 12 of the fixing block 10 with the front end of the semi-circular groove 23 of the inserting block 20 and the front end of the semi-circular groove 14 of the fixing block 10 contacted. At this state, the movement of the inserting block 20 is limited despite the rotation of the fixing bolt 30, and the tightness of the electrode 210 of the battery 200 does not increase further, thereby preventing the transformation of the electrode 210 of the battery 200 by excessive tightening.

Meanwhile, the battery terminal 100 of the present invention is constructed to enhance electric conductivity of the device.

In the present invention, as shown in FIG. 3, the semi-circular groove 23 of the inserting block 20 and the semi-circular groove 14 of the fixing block 10 are arranged to completely enclose the outer surface of the electrode 210 of the battery 200, maximizing the contacting area of the electrode 210 of the battery 200 thereby reducing electric resistance and greatly enhancing electric conductivity compared to conventional battery terminals in which the battery electrode is partially contacted.

Also, the battery terminal 100 of the present invention can enhance the productivity of work of connecting the electrode 210 of the battery 200. In the present invention, the fixing bolt 30, as shown in FIG. 2, is connected from the upper part to lower part of the inserting block 20 and the fixing block 10, which make it possible to easily connect the fixing bolt 30 even when the electrode 210 of the battery 200 is located at dented place. Therefore, the productivity of connecting the electrode 210 of the battery 200 is greatly enhanced compared to conventional battery terminal in which the fixing bolt is connected at the side surface or at lower surface.

The present invention has been described with reference to preferable embodiments, but the invention is not limited to specific examples which have been presented to illustrate the invention. The invention should be interpreted by the claims and any modification or addition with the same technical idea as the invention is within the scope of the present invention.

What is claimed is:

1. A battery terminal comprising:

a fixing block which comprises a protrusion member having a bolt through hole on one side of the outer surface of the protrusion member for connecting to a connection terminal to which a cable is connected, an inclined surface on one side of the inner surface with downward inclination, a through hole at lower portion in front of the inclined surface with inner peripheral surface in spiral shape, and a semi-circular groove at one side of the inner surface facing the inclined surface with the semi-circular groove contacting an electrode of a battery;

an inserting block which is inserted into the fixing block and which comprises an inclined surface on one side of the outer surface contacting the inclined surface of the fixing block with the same inclination as the inclined surface of the fixing block, a long groove at the front portion of the inclined surface, and a semi-circular groove in front of the long groove with the semi-circular groove of the inserting block facing the semi-circular groove of the fixing block and contacting the outer surface of the electrode of the battery; and a fixing bolt which penetrates through the long groove of the inserting block and is connected to the through hole of the fixing block.

2. The battery terminal of claim 1, wherein the diameter of the semi-circular groove of the fixing block is the same as the diameter of the electrode with the diameter increasing from upper end to lower end.

3. The battery terminal of claim 1, wherein the diameter of the long groove of the inserting block is larger than the diameter of the body of the fixing bolt.

4. The battery terminal of claim 1, wherein the diameter of the semi-circular groove of the inserting block is the same as the diameter of the electrode of the battery with the diameter increasing from upper end to lower end.

* * * * *